US011267264B2

(12) United States Patent
Krieger et al.

(10) Patent No.: US 11,267,264 B2
(45) Date of Patent: Mar. 8, 2022

(54) METHOD FOR AUTOMATED ALIGNMENT AND REGISTER MEASUREMENT USING CIRCULAR MEASURING MARKS

(71) Applicant: HEIDELBERGER DRUCKMASCHINEN AG, Heidelberg (DE)

(72) Inventors: Jan Krieger, Heidelberg (DE); Immanuel Fergen, Karlsruhe (DE); Christoph Godau, Mannheim (DE); Timo Volk, Mannheim (DE); Manfred Schneider, Bad Rappenau (DE)

(73) Assignee: Heidelberger Druckmashinen AG, Heidelberg (DE)

( * ) Notice: Subject to any disclaimer, the term of this patent is extended or adjusted under 35 U.S.C. 154(b) by 12 days.

(21) Appl. No.: 16/563,326

(22) Filed: Sep. 6, 2019

(65) Prior Publication Data

US 2020/0079119 A1 Mar. 12, 2020

(30) Foreign Application Priority Data

Sep. 12, 2018 (DE) ..... 10 2018 215 500.3

(51) Int. Cl.
*B41J 11/42* (2006.01)

(52) U.S. Cl.
CPC ..... *B41J 11/42* (2013.01)

(58) Field of Classification Search
CPC ..... B41J 2/2146; B41J 11/42; B41F 13/025
See application file for complete search history.

(56) References Cited

U.S. PATENT DOCUMENTS 4,546,700 A * 10/1985 Kishner ..... G06T 3/4015 101/181
5,056,430 A 10/1991 Bayerlein et al.
6,154,230 A 11/2000 Holstun et al.
6,234,602 B1 5/2001 Soto et al.
6,565,206 B2 5/2003 Okabe et al.
(Continued)

FOREIGN PATENT DOCUMENTS

CN 101237992 A 8/2008
CN 1693075 B 9/2010
(Continued)

*Primary Examiner* — Lam S Nguyen
(74) *Attorney, Agent, or Firm* — Laurence A. Greenberg; Werner H. Stemer; Ralph E. Locher

(57) ABSTRACT

A method for automated alignment and register measurement in a printing press provides for test patterns having multiple color separations to be printed by the printing press on a printing substrate, recorded by using at least one image sensor of an image acquisition system as a digital overall image, evaluated by a computer with respect to an alignment/register offset and then corrected by the computer for the alignment/register offset. Circular measuring marks having known diameter for each color separation are integrated into the test patterns and the computer ascertains the center position of each circular measuring mark with subpixel accuracy and thus computes the alignment/register offset by cutting out an image region having at least one circular measuring mark from the digital overall image and determining parameters of a model of a printing point of the circular measuring mark from the digital overall image.

8 Claims, 5 Drawing Sheets

(56) References Cited

U.S. PATENT DOCUMENTS

| | | | |
|---|---|---|---|
| 6,782,814 | B2 | 8/2004 | Tokiwa |
| 7,225,735 | B2 | 6/2007 | Zuber et al. |
| 7,637,210 | B2 | 12/2009 | Geissler et al. |
| 8,161,876 | B2 | 4/2012 | Geissler et al. |
| 8,807,684 | B2 | 8/2014 | Allworth et al. |
| 9,862,204 | B2 | 1/2018 | Izume |
| 10,336,095 | B2 * | 7/2019 | Tsukada ..... B41J 2/2146 |
| 10,549,525 | B2 | 2/2020 | Chishiki et al. |
| 2006/0273782 | A1 | 12/2006 | Galton et al. |
| 2011/0074861 | A1 | 3/2011 | Saettel et al. |
| 2019/0077143 | A1 | 3/2019 | Krieger et al. |
| 2019/0152215 | A1 | 5/2019 | Fujimaki |

FOREIGN PATENT DOCUMENTS

| | | | |
|---|---|---|---|
| CN | 102765249 | A | 11/2012 |
| CN | 104619503 | A | 5/2015 |
| CN | 105764692 | A | 7/2016 |
| CN | 109484045 | A | 3/2019 |
| DE | 3809941 | A1 | 10/1988 |
| DE | 60303762 | T2 | 8/2006 |
| DE | 102011009791 | A1 | 8/2012 |
| DE | 102004021597 | B4 | 4/2017 |
| DE | 102018211922 | A1 | 3/2019 |
| EP | 0999064 | A1 | 5/2000 |
| JP | H10151755 | A | 6/1998 |
| JP | H1148458 | A | 2/1999 |
| JP | 2003025530 | A | 1/2003 |
| JP | 3564388 | B2 | 9/2004 |
| JP | 2006240141 | A | 9/2006 |
| TW | 201805180 | A | 2/2018 |
| WO | 0027638 | A1 | 5/2000 |
| WO | 201829848 | A1 | 2/2018 |

* cited by examiner

METHOD FOR AUTOMATED ALIGNMENT AND REGISTER MEASUREMENT USING CIRCULAR MEASURING MARKS

CROSS-REFERENCE TO RELATED APPLICATION

This application claims the priority, under 35 U.S.C. § 119, of German Patent Application DE 10 2018 215 500.3, filed Sep. 12, 2018; the prior application is herewith incorporated by reference in its entirety.

BACKGROUND OF THE INVENTION

Field of the Invention

The invention relates to a method for automated alignment and register measurement in a printing press by using a computer.

The invention is in the technical field of printing quality control.

When carrying out printing processes, the subsequent quality control of the produced printing products is a very important component. One significant component of such printing quality controls is checking the so-called register, depending on the interpretation, which is also known as alignment. In the classical perspective, register refers in general to the location of the subject on the printing substrate, while alignment means printing individual color separations one on top of another in multicolor printing. In particular, in the case of such multicolor printing using various color separations, in which the individual color separations have to be printed precisely one on top of another, a displacement of the subject or individual printing objects in the printed image of individual color separations can have the result that so-called alignment errors occur. Those types of displacements, which can also be referred to as alignment offset or register offset, may be divided into peripheral register and lateral register. The peripheral register offset refers in this case to a displacement of a specific color separation upward or downward, as viewed in relation to the other color separations. In contrast, the lateral register refers to a corresponding displacement to the left or right in relation to the other color separations. A further register offset relates to the so-called diagonal register.

In order to ascertain the register offsets, test patterns/test marks are typically printed adjacent the actual printed image as a part of the subject. The register marks are formed, for example, of objects of the individual color separations in a specific geometric configuration. In the case of a register offset of one or more color separations, it may thus be ascertained immediately which color separation has the offset and precisely the type of the deviation. The evaluation of the printed register mark can be performed manually by a user. However, automated evaluation is presently substantially more typical, for example by using a separate specific register sensor which acquires the register marks and supplies them to a computer, which evaluates them with respect to a possible register offset. The use of an image acquisition system, which is actually used for the quality control of the printed subject and is usually attached in-line inside the printing press after the last printing unit, is also known. If the register offset was ascertained, either the user or printer can compensate for the register offset manually or the controller of the printing press can compensate for it automatically. That is carried out, for example, by accordingly adapting the printed image data of the individual color separations in the opposite direction. Mechanical adaptations by correction of the peripheral, lateral, and diagonal register by the user are also possible up to a certain degree.

Those methods for ascertaining the register offset have the disadvantage, however, that a completely separate analysis system having register sensor and separate register marks, which are read out by the register sensor, is usually necessary. In order to reduce that expenditure, other image sensors or cameras, the task of which represents, for example, checking the printing quality with respect to the image content or the color control, are often used to evaluate the register marks, as already mentioned. However, that is only possible if the cameras have a sufficiently high image resolution, so that they can also accurately acquire and evaluate the register marks.

Furthermore, German Patent DE 10 2004 021 597 B4, corresponding to U.S. Pat. Nos. 7,637,210 and 8,161,876, is known from the prior art and discloses a register mark which is read out by a register sensor, wherein the register mark, however, additionally contains a further field for color measurement of the register color to be regulated. In that case, the evaluation of the register offset is thus linked to the color control of the printing process. The register sensor is used in that case not only to read out the register offset from the register mark, but rather also the color value of the corresponding color separation. The register mark presented in that case is thus a quasi-hybrid of a register mark and a color measurement field or color control strip. The expenditure for the color control is thus reduced by that method, but not the expenditure for ascertaining the register offset. Moreover, it is often also not desirable to link register offset and color control in such a manner, since that approach does not supply optimum results in particular in the case of very high quality demands for the color control.

Moreover, a method for solving that problem is known from German Patent Application DE 10 2018 211 922 A1 which uses test patterns formed of circular disks and, by way of a center determination of the circular disks, ascertains the camera alignment of the image acquisition system, the printhead alignment of an inkjet printing press, and possible alignment and register offsets in the printing process of the inkjet printing press and corrects them accordingly. However, that method is developed for the inkjet printing press and uses very specific test patterns. Those test patterns require an entire sheet, which is filled with corresponding circular disks, to be able to compute alignment errors therefrom by using the method. That is less well suited for the standard alignment and register measurement in a printing press, particularly in an offset printing press, of course, but also in an inkjet printing press, since the paper waste increases and the productivity of the printing process is reduced accordingly. A possibility thus has to be found to also use that method and/or the circular test fields known therefrom for a standard method for automated alignment and register measurement, in which the test patterns known therefrom having the circular test fields and the corresponding method for center determination are adapted so that they can be used by using normal test patterns, which simply do not fill up an entire sheet.

SUMMARY OF THE INVENTION

It is accordingly an object of the invention to provide a method for automated alignment and register measurement in a printing press using circular measuring marks, which overcomes the hereinafore-mentioned disadvantages of the heretofore-known methods of this general type and which makes use of a known method for center determination of circular test cases, but is more efficient than the method previously known from the prior art.

With the foregoing and other objects in view there is provided, in accordance with the invention, a method for automated alignment and register measurement in a printing press by using a computer, wherein test patterns having multiple color separations are printed by the printing press on a printing substrate, recorded by using at least one image sensor of an image acquisition system in the form of a digital overall image, evaluated by the computer with respect to an alignment/register offset and then corrected by the computer with regard to the alignment/register offset. Circular measuring marks having known diameter for each color separation are integrated into the test patterns and the computer ascertains the center position of each circular measuring mark with subpixel accuracy and thus computes the alignment/register offset. In order to ascertain the center position of each circular measuring mark, the computer cuts out an image region having at least one circular measuring mark from the digital overall image and determines parameters of a model of a printed point of the circular measuring mark from the digital overall image.

The basic concept of the method according to the invention is that known methods for center ascertainment of circular measuring marks or ascertainment of test fields are integrated into a method for automated alignment and register measurement. In the method according to the invention, test patterns, which are actually used for the color control and are placed adjacent the actual printed image in the form of color control strips, are printed, digitized by using an image acquisition system, and then evaluated by a computer with respect to an alignment and register offset. It is thus no longer necessary to use a separate register sensor and separate register marks. Therefore, in order to use the known method for center determination of circular measuring marks in the test patterns, the same circular measuring marks having a known diameter for each color separation have to be integrated into the corresponding test patterns. The need to use test patterns which extend over the entire sheet as in the prior art method is thus avoided. It is entirely sufficient to integrate the circular measuring marks into the color control strips, which are located outside the actual printed image and thus also do not result in increased paper waste and reduced productivity. In the prior art method for center determination of the circular measuring marks, those test patterns which extend over the entire sheet are necessary, since the actual background of that method is in the position ascertainment of the image sensor or the camera, and in the position acquisition of the printheads of an inkjet printing press. Such test patterns filling up sheets are necessary for that purpose. However, much smaller test patterns are entirely sufficient for a method for automated alignment and register measurement. Due to the integration into the color control strips, which are actually intended for the color measurement, in one stroke, one avoids not only the use of test patterns filling up the complete sheet, but rather one can additionally dispense with separate register marks which have to be evaluated by a separate register sensor. The method according to the invention moreover provides a significant efficiency boost in this case in comparison to the methods known from the prior art. The required model is defined in this case by a radial intensity curve from the center point of the circular disk outward. The radial intensity curve is in turn defined basically as a step from the central color value to the background value at the radius RO, which is also widened to a width to take into consideration the limited imaging performance of the objective lens.

Advantageous and therefore preferred refinements of this invention result from the associated dependent claims and also from the description and the associated drawings.

A further preferred refinement of the method according to the invention in this case is that the circular measuring marks are disposed on the printing substrate so that they are completely acquired by a single image sensor and are imaged in a single digital overall image. The image acquisition system can have multiple image sensors and/or cameras. In order to ensure that the method for ascertaining the center position of each circular measuring mark is carried out, however, it is necessary for each circular measuring mark in the test pattern to be completely acquired by at least one single image sensor and accordingly imaged in a single digital overall image. If a circular measuring mark were only partially acquired by one image sensor and the other part were acquired by a further image sensor, the resulting two images would thus have to be reassembled by the computer thereafter to enable a further evaluation. However, errors in the assembled image can occur due to such an assembly of the two images, for example due to an insignificant displacement of the two image halves. However, that would be extremely negative for the usability of the corresponding circular measuring mark.

Another preferred refinement of the method according to the invention in this case is that closed circular disks or open circular rings having known diameter for each color separation are used as circular measuring marks. Open circular rings theoretically have the advantage in relation to closed circular disks that they are less susceptible to printing-technology artifacts. The closed circular disks have in turn already proven themselves in use. One thus knows that it functions practically, while there are not yet nearly as many experiential values provided for the use of open circular rings.

An added preferred refinement of the method according to the invention in this case is that the method is carried out for the ascertainment of the alignment offset between printing bars made of printheads disposed adjacent one another of an inkjet printing press and the circular measuring marks are disposed in lines horizontally or vertically on the printing substrate. The fundamental method of using the method for center determination of circular measuring marks for the alignment and register measurement by using analysis of circular measuring marks placed in the color control strip may basically be divided into two main areas of application. The first is the ascertainment of the alignment offset between the printing bars in an inkjet printing press. Alignment and/or register measurement thus means nothing more in this case than the ascertainment of the alignment offset between these respective printing bars. This thus does not mean the classical alignment of the color separations which extend over the entire printed image, but rather the alignment which is caused by the individual printing bars disposed adjacent one another. In order to accordingly ascertain this alignment offset between the printing bars, the circular measuring marks in the test pattern or in the color control strip are to be disposed in lines horizontally or vertically on the printing substrate. It is important that the corresponding line extends over more than one of the printheads disposed adjacent one another, since the corresponding alignment offset between these printheads disposed adjacent one another can thus be ascertained.

An additional preferred refinement of the method according to the invention in this case is that, for the ascertainment of the alignment offset between the printing bars by the computer, the deviations of the center position of the circular measuring mark from its known ideal positions are determined, an outlier-robust regression method is applied to average these deviations over the printing substrate, the alignment offset is ascertained therefrom and compensated by the computer by opposing driving of the printing bars. The condition for this, of course, is that, on one hand, the ideal position or target position of the center of the circular measuring marks is known and, on the other hand, that the real actual positions of the center of the circular measuring mark were correctly ascertained by the corresponding method for center ascertainment. If this is the case, a straight line may be laid through all point deviations of a color separation and/or all point deviations may be averaged. This straight line is then a model for the alignment of the printing bar in the frame and thus permits the determination of the mean deviation from the ideal horizontal at any arbitrary point. Optionally, for further improvement of the ascertained and averaged point deviations, one or more further measurements of further equivalent test patterns can also be carried out. If the alignment of the printing bar in space is thus ascertained, the alignment offset between the printing bars may be ascertained therefrom and compensated for by the computer by opposing driving of the printing bars.

Another preferred refinement of the method according to the invention in this case is that the circular measuring marks cannot be printed in the overlap region between two printheads. Since the individual circular measuring marks can each only be printed by one printhead because of the fact that the printheads disposed adjacent one another can have an alignment offset, they therefore cannot be printed in the overlap region, the so-called stitching, between two printheads.

A concomitant preferred refinement of the method according to the invention in this case is that the method is carried out for the ascertainment of the alignment/register offset in an offset printing press and the circular measuring marks are integrated into existing printing control strips, wherein the circular measuring marks replace color measuring fields which were previously suitable.

The second possible application of the fundamental method of the use of the method for center ascertainment of circular measuring marks in an integrated method for automated alignment and register measurement by the use of color control strips having these circular measuring marks is in the use of the alignment/register measurement for offset printing presses. The circular measuring marks are integrated in this case into existing printing control strips and/or color control strips and only replace the previous color measuring fields. Since the circular measuring marks each also represent one color separation, using them, the actual color measurement may be carried out in this printing control strip and also the ascertainment of the alignment/register offset may be carried out simultaneously by application of the method for center determination of the circular measuring marks.

The method described herein is also carried out while being supported by a computer as in the method for ascertaining the alignment offset between the printing bars made of printheads disposed adjacent one another of the inkjet printing press, wherein the computer is preferably the image processing computer of the image acquisition system. However, any other computer which has access to the data which are generated by the image acquisition system is also possible. A division of the tasks between various computers is also an option. Thus, for example, the evaluation and ascertainment of the alignment/register offset can be carried out by the computer of the image acquisition system, while the correction of the ascertained alignment/register offset is carried out by the control computer of the printing press. Precisely which computer is used for which purpose is generally dependent in this case on the structure of the printing press system.

Other features which are considered as characteristic for the invention are set forth in the appended claims. The invention as such and also constructively and functionally advantageous refinements of the invention are described in greater detail hereafter with reference to the associated drawings on the basis of at least one preferred exemplary embodiment.

Although the invention is illustrated and described herein as embodied in a method for automated alignment and register measurement using circular measuring marks, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
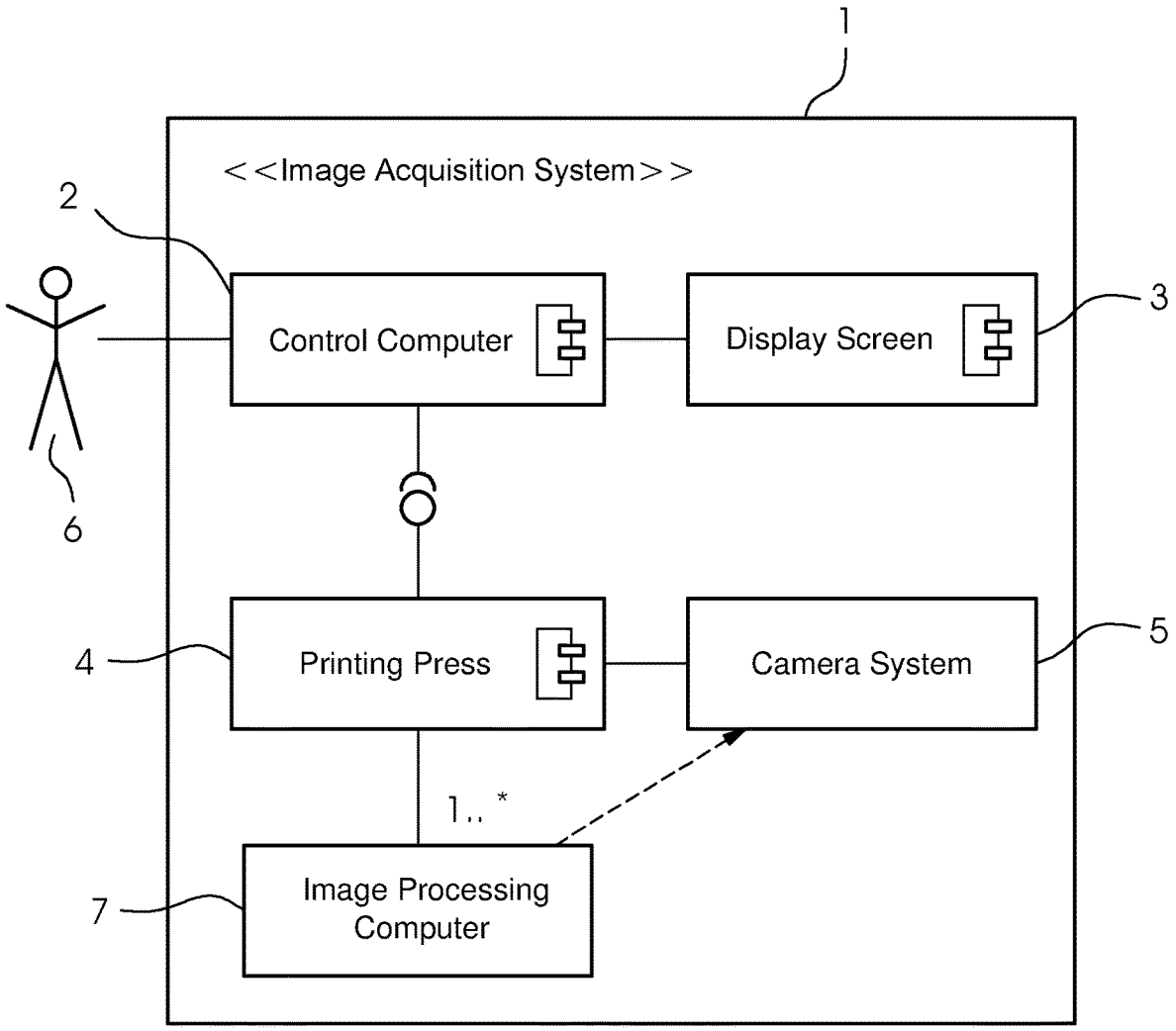
FIG. 1 is a block diagram showing the construction of an image acquisition system.

Referring now in detail to the figures of the drawings, in which elements corresponding to one another are provided with the same reference signs, and first, particularly, to FIG. 1 thereof, there is seen an installed image acquisition system 1 typically having a printing press 4, multiple cameras 5 and a separate image processing computer 7 as a measuring system, as has become the case in inkjet and offset printing presses 4 of the higher price/performance category, in which the images of its cameras 5 can thus be used for a register measurement. This system has the advantage that a user 6 no longer has to manually read out and evaluate register marks or color control strips 19, etc. FIG. 1 schematically shows the structural composition of such an image acquisition system 1, which uses the method according to the invention. The system is formed of at least one image sensor, typically a camera 5, which is integrated into the printing press 4. The at least one camera 5 records printed images produced by the printing press 4 and transmits the data to a computer 2 for analysis. This computer 2 is preferably an independent separate computer 2, for example one or more specialized image processing computers 2, but can also be identical to the control computer 2 of the printing press 4. At least the control computer 2 of the printing press 4 has a display screen 3, on which the results of the image inspection are displayed.

Figure 2:
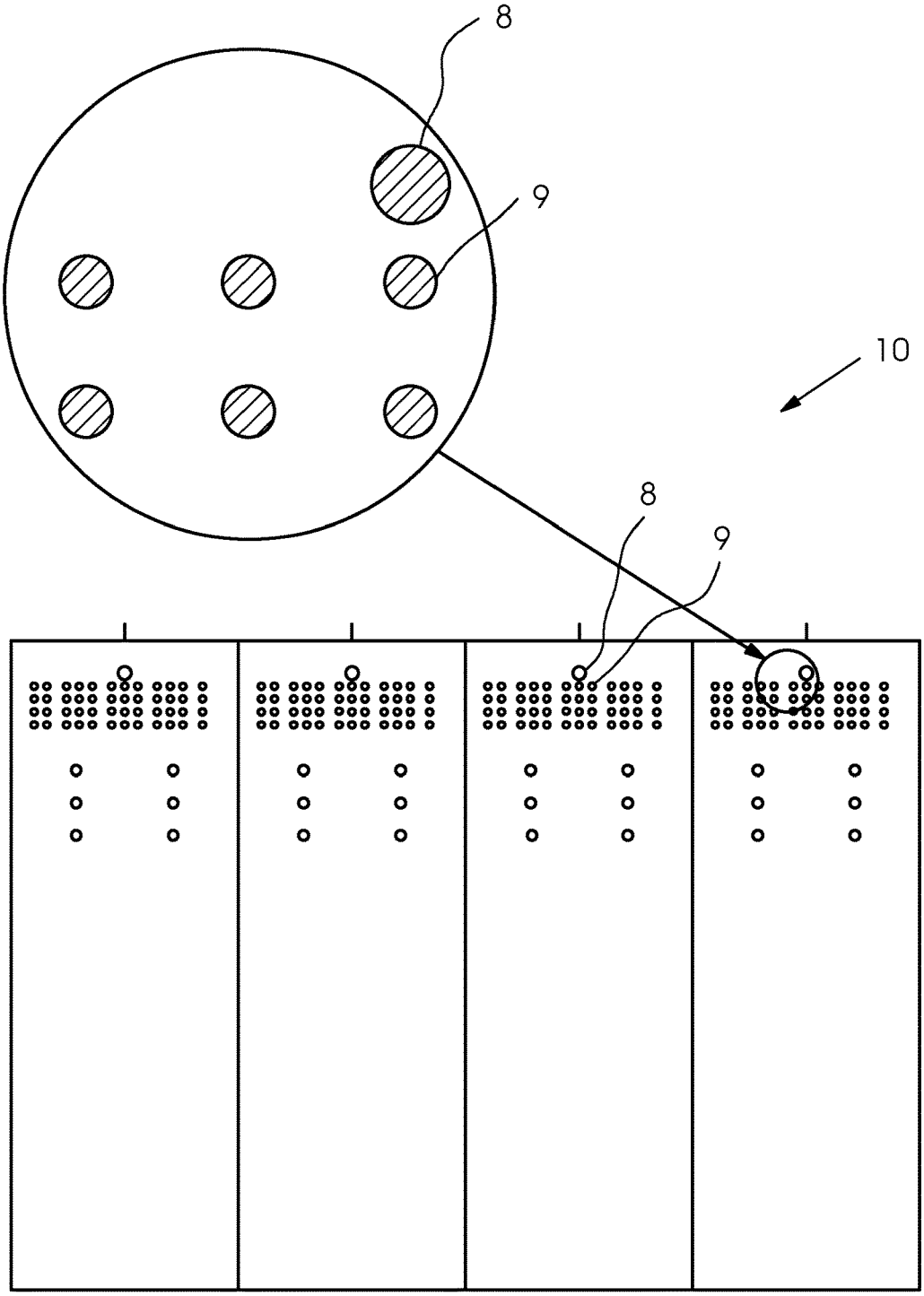
FIG. 2 is a top-plan view of an example of a test pattern sheet used for a color separation.

FIG. 2 shows an example of the use of a test printing pattern 10 known from the prior art, which only contains one color separation. In this case, of course, the test printing pattern 10 then has to be printed and evaluated for each color separation. The standard evaluation of such a test printing pattern 10 runs as follows in this case:

Lines of filled circular disks 9 are disposed on a printed sheet, so that each printhead produces circular disks 9. At least three circular disks 9 are distributed per printhead in this case, in such a way that they are not printed in the stitching region. Each printhead is to print at least two complete sets of circular disks 9 located adjacent one another. The circular disks 9 are to be distributed in this case over the sheet in such a way that the largest possible region is spanned in the y direction. This guarantees a high resolution in both coordinate directions (x: printing bar direction, y: paper transportation direction). The circular disks 9 have to be sufficiently large that they provide good results for the method according to the invention even upon the presence of white lines or diagonally spraying nozzles. The disk size may be determined experimentally with the aid of a simulation. A target size of 60 camera pixels or, at 670 dpi camera resolution, >2.2 mm diameter, is sufficient for images of high quality from the above-described camera system 5. With some spacing in relation to the large lines and as close as possible to the beginning of the printing pattern, one additional offset point 8 is disposed per camera 5, which enables a referencing ("grid point" 8) for the point search. The requirements are the same as already described.

For the following method, a partial method is necessary, which determines the center point of a circular disk 9 with subpixel accuracy. The method used for this purpose is performed as follows:

Since the printing color for the circular disk 9 to be examined is known, the image can be ideally converted into a high-contrast grayscale image with the aid of this information, for example, by selecting the channel R, G, or B having highest contrast to the printed material. A region (ROI) approximately two times larger than the actual circular disk 9 is cut out of the overall image converted into grayscale. In the ROI having the circular disk 9, an edge detection is carried out, so that the edge of the circular disk 9 remains as a 1-pixel-wide line in a binary image 10. In order to filter out line artifacts in the circular disks 9, which now stand out as double lines, a further filter is applied, which firstly finds vertical lines in the binary image which is formed of one pixel and are at least nine pixels tall and then subtracts them from the mask, which results in an error-free circular disk 9 after the edge detection. The limit of at least nine pixels is selected as configurable for adaptability of the method to other camera resolutions. The binary image is expanded by a cross through the center point of the circular disk 9 approximately determined as the mass center of gravity. The result is referred to as MASK. The MASK is finally widened by dilation to three to five pixels. The determination of how many pixels it is precisely widened by is dependent on the imaging power and/or the step response of the camera system being used. A nonlinear least-squares fit is now carried out on the masked ROI data, wherein the parameters of a model of the printed point are determined. The model is defined by a radial intensity curve f(r) from the center point (x0, y0) of the circular disk outward. The radial intensity curve f(r) is basically defined as a step from the central color value (A0+A1) to the background value A0 at the radius r0, which is also widened to a width w in order to take into consideration the limited imaging power of the objective lens. Moreover, an asymmetry factor a can be taken into consideration in order to take into consideration, for example, unequal resolutions in the x and y directions. This also relates, for example, to a reduction of the resolution in one direction to compensate for higher printing speeds.

Firstly, reasonable starting parameters are selected for all of these parameters. Such parameters are, for example, the mass center of gravity of the image for $x_0$, $y_0$, the radius for $r_0$ expected from the printed image, machine experiential values for w, etc. The fit is then executed by using a standard method of numerics, for example, a Levenberg-Marquardt method.

The results are checked for meaningfulness. Thus, for example, the radius or the center has to be located in the expected region. If this is not the case, the corresponding circular disk 9 is discarded in case of doubt and not used for the further analysis. This algorithm also still functions if the circular disk 9 is not completely in the ROI, but rather only a portion >50-60% is visible. However, the accuracy then possibly suffers. This can be taken into consideration through a weighting or a scoring of the results, however.

This standard method for the evaluation of the test pattern 10 having circular disks 9 is to be used for the in-line measurement and regulation of the alignment/register deviation for a sheet-fed offset printing press 4. Various adaptations of the alignment/register marks previously used are required for this purpose. The calibration points/circular disks 9 are therefore now integrated into the previous color control strips 19.

Figure 3:
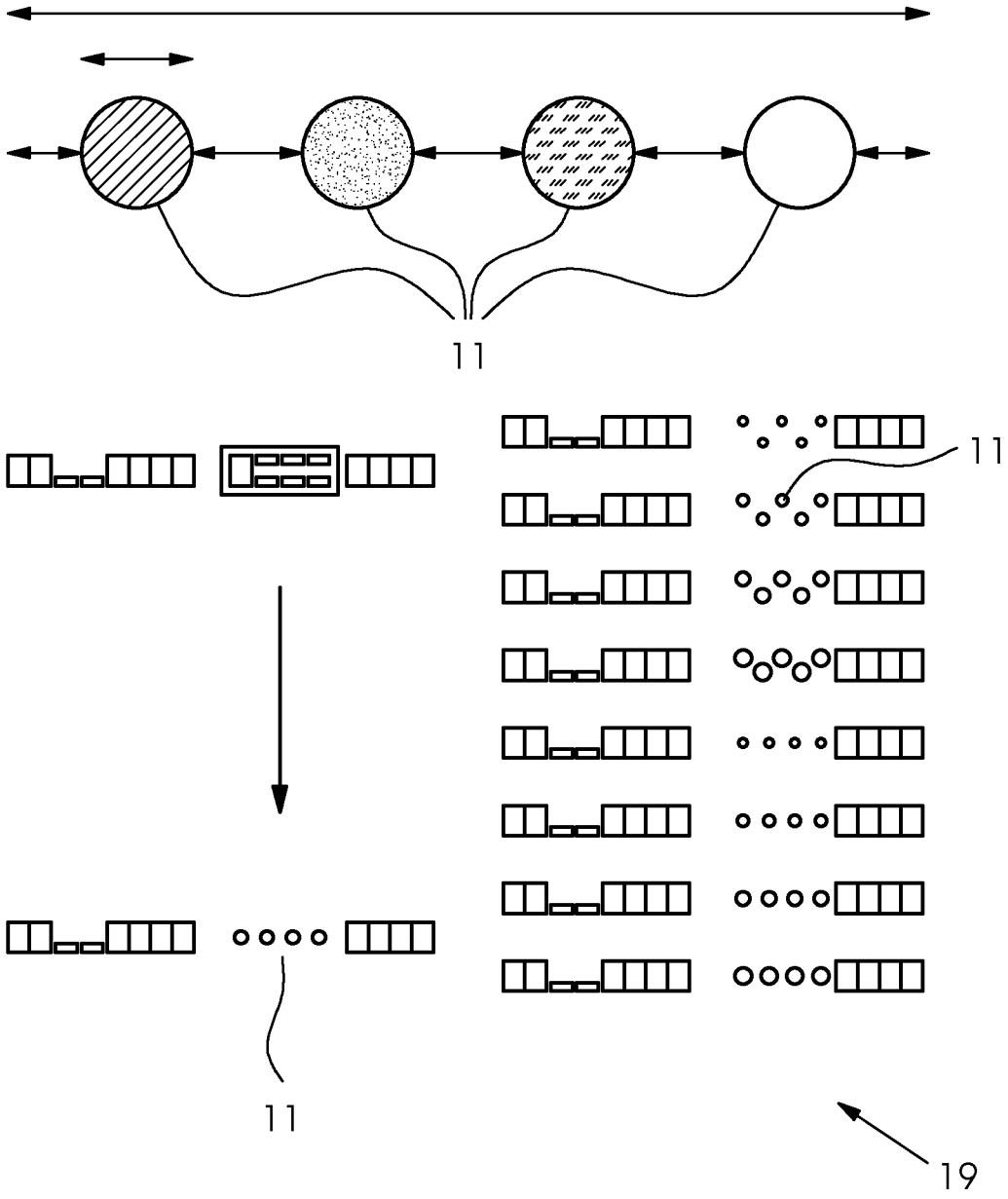
FIG. 3 is a top-plan view of an example of circular disks integrated into offset color control strips.

FIG. 3 shows the result of such an offset color control strip 19 having integrated calibration points/circular disks 11. The resolution of the image acquisition system 1 being used can also be less in this case than the alignment/register misalignments to be detected (subpixel). The configuration of the individual measuring marks or circular disks 11 for the respective color separations takes into consideration the maximum adjustability without overlap of the measuring marks.

One example for the use of a color control strip 19 having integrated circular disks 11 is described in greater detail hereafter:

A horizontal line having circular disks 11 is used, with at least one circle per printing unit and integration into the known printing control strips is possible.

The length of the line is: L=2*xa+4*d+3*xi and the diameter of a circular disk 11 is d=(L−2*xa−3*xi)*¼, with xi=0.8 mm as the spacing between the circular disks 11 and xa=0.5 mm for the spacing of the line in relation to the closest object of the color control strip 19 which then results in a length of the line L=13 mm with d=2.275 mm for the maximum possible diameter d of a circular disk 11. In general, the possible diameter is in the range of 0.2 to 5 mm.

The described method for analyzing the circular disks 11 can then be carried out by using this adapted color control strip 19, and therefore alignment/register deviations can be computed without having to use separate register marks. The integration of the circular disks 11 into the color control strips 19 does not obstruct its actual task in the case of the color measurement or color control, since the circular disks 11 also depict various color separations and are suitable for the color measurement.

The application appears somewhat different for use in inkjet printing presses 4. The alignment between two printing bars 15, which are each formed of printheads disposed adjacent one another, is to be measured in this case. The alignment/register offset between the printheads of one color is thus not meant, but rather between the entire printing bars 15 of different colors. This roughly corresponds to the alignment between the color separations.

Figure 4:
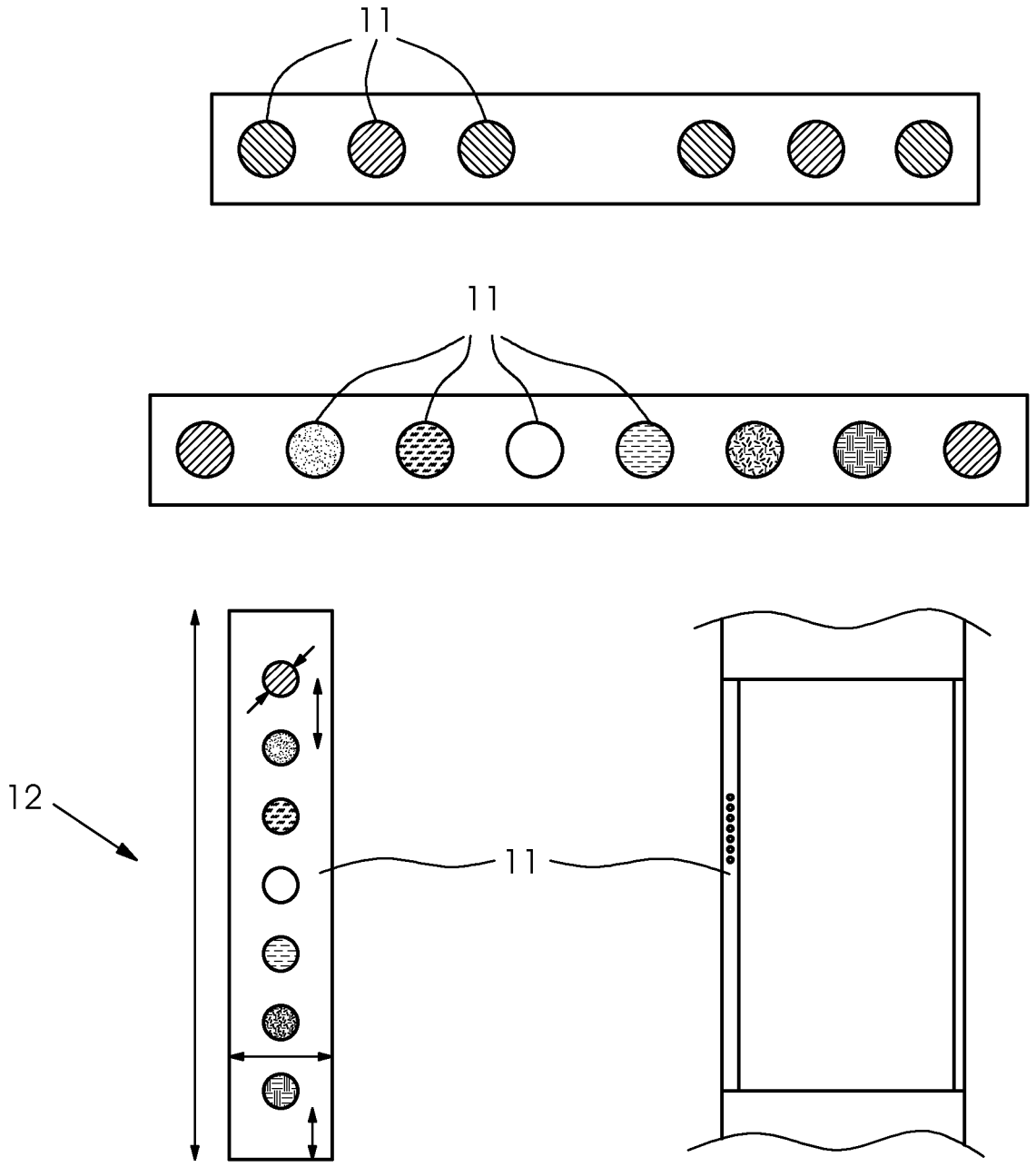
FIG. 4 is a top-plan view of an example of alignment/register marks having circular disks for inkjet printing presses.

The register marks required for this purpose, i.e., adapted inkjet test printing patterns 12 of various color separations, are formed of circular disks 11 having a minimum diameter, so that the presence of defective printing nozzles in the printhead also has no influence on the alignment measurement. FIG. 4 shows an example of the construction and the configuration of the adapted inkjet test printing pattern 12 in the printed image. A standard pattern adapted according to the invention is shown in the top of the figure. Two circular disks 11 are printed in the printhead per color in this case, and one circular disk 11 of the reference color, against which measurement is performed, is printed in between for referencing. The configuration shown below in FIG. 4 is then an expansion of the standard pattern according to the invention, which also permits the measurement of various colors in one strip, while in the adapted standard pattern, only the exactly one alignment could be measured. The line in the adapted inkjet test printing pattern 12 of FIG. 4 is placed vertically or horizontally in this case similarly to a color control strip 19, depending on the place on the subject, adjacent the actual printed image. In this case, the vertical configuration is preferred. It is important that the circular disks 11 are not printed in the overlap region between two printheads (stitching region), to avoid errors due to incorrectly adjusted printheads. Moreover, a group of circular disks 11, which enables a complete measurement on one circular disk 11, always has to be completely acquired by a camera 5 to avoid errors due to the inaccurate adjustment/alignment of two cameras 5 in relation to one another.

Figure 5:
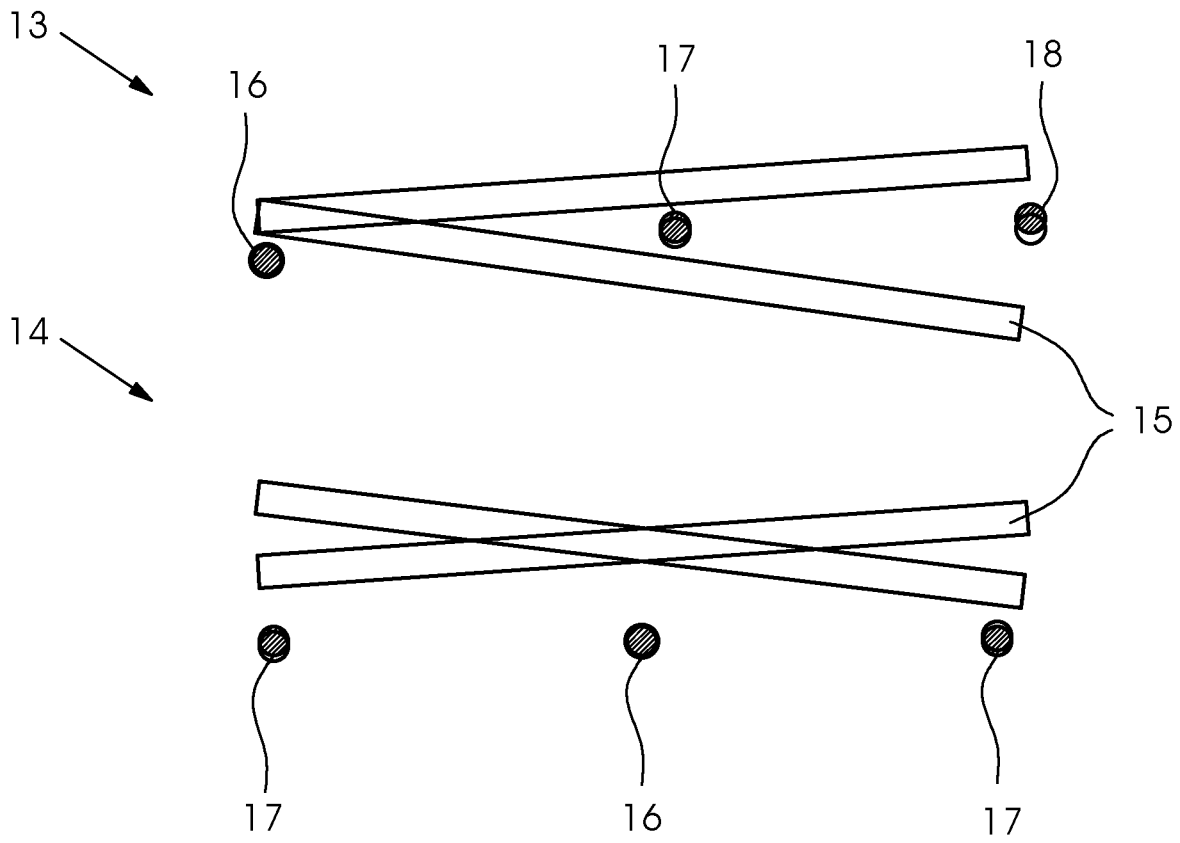
FIG. 5 is a side-elevational view of an example of alignment errors in each case without and with corrected tilting of printing bars.

The regulation method for the alignment of the printing bars 15 in relation to one another is performed as follows in this case and is schematically illustrated once again with respect to the results in FIG. 5. The top part of FIG. 5 shows an alignment error 13 which occurs if the alignment is regulated without consideration of the alignment between the printing bars 15. It can be seen very well how the left circular disks 11 are adjusted out well and display a minimal alignment deviation 16, while the middle and right circular disks 11, however, each have a respective moderate alignment deviation 17 or large alignment deviation 18, due to the printing bar offset. This is regulated better in the bottom part of FIG. 5, where an alignment error 14 is adjusted out in consideration of the alignment between the printing bars 15. In the worst case, moderate alignment deviations 17 occur therein. The method for adjusting out in consideration of the alignment between the printing bars 15 is performed as follows in this case:

1. Determine alignment deviations of one or each color in relation to a reference color (typically: BLACK).
   a. Roughly find and cut out all circular disks 11, this can optionally also be carried out through a circle feature detection (for example, a Hough transformation).
   b. Determine the center position of each circular disk 11 with subpixel accuracy.
   c. Convert center positions with the aid of coordinate transformation into real coordinates (for example, millimeters or printing pixels).
   d. For deviations transverse to the orientation of the test strip, a straight line can be laid through the positions found of the circular disks 11. For this purpose, an outlier-robust regression method, such as iteratively-reweighted-least-squares (IRLS), or a normal least-squares fit is used. This is carried out for measuring and reference colors and the spacing of the straight lines can then be computed at any arbitrary point to determine the alignment transverse to the orientation of the test strip. It can possibly be taken into consideration in this case that measuring and reference points were not printed on a line. The two straight lines also enable the angle between the printing bars 15 to be measured. Alternatively, a method as described in e. can also be used.
   e. For deviations along the test strip, the expected ideal position of the circular disks 11 is determined (for example, by a predetermined calibration of the cameras 5 or a local calibration or coordinate transformation computed from surrounding reference points between the printed image and the camera image). The deviation of the found position from the expected position is then the alignment error at the measuring mark.
   f. Optionally: averaging of the measurements from various sheets and/or various measuring patterns on one sheet.
   g. Determine X/Y offset, so that the alignment deviations are minimized over the entire sheet—i.e., the deviations do not set the left side to zero, for example, but the right side is excessively large in exchange, as seen in FIG. 5, the bottom image.
2. Adjust determined X/Y offset in machine controller in the opposite direction to compensate for the measured deviation.
3. Further measurement:
   a. Deviation less than limit->FINISHED.
   b. Deviation greater than limit->back to step 1.

In a further preferred embodiment variant, open circular rings having suitable diameters can moreover also be used for both applications instead of the circular disks 9, 11, if they can also be integrated into already known printing control strips 19 or register marks. They are theoretically less susceptible to printing-technology artifacts.

The advantages of the method according to the invention for both applications, i.e., offset and inkjet, are that a separate measuring device is no longer required for the register/alignment regulation, since the camera 5 of the image acquisition system 1, which is provided in any case, is used. Moreover, averaging over multiple sheets is possible and special marks can also be used at any arbitrary point on the sheet.

The following is a summary list of reference numerals and the corresponding structure used in the above description of the invention:

1 image acquisition system
2 control computer of the printing press
3 display screen
4 printing press (inkjet or offset)
5 image sensor/camera system
6 user
7 image processing computer
8 grid point for referencing for a color separation
9 calibration points/circular disks of a color separation
10 standard inkjet test printing pattern for a color separation
11 calibration points/circular disks of various color separations in the adapted test pattern
12 adapted inkjet test printing pattern of various color separations

13 alignment register errors in printing bars without corrected tilting

14 alignment register errors in printing bars with corrected tilting

15 printing bar of a printhead

16 well-adjusted alignment

17 moderate alignment deviation

18 large alignment deviation

19 offset color control strips having integrated calibration points/circular disks

The invention claimed is:

1. A method for automated alignment and register measurement in a printing press, the method comprising the following steps:

using the printing press to print test patterns having multiple color separations on a printing substrate;

using at least one camera of an image acquisition system to record the print test patterns as a digital overall image;

using the computer to evaluate the digital overall image with respect to an alignment/register offset and then using the computer to correct the alignment/register offset;

integrating circular measuring marks of known diameter into the test patterns for each color separation; and using the computer to ascertain a center position of each circular measuring mark with subpixel accuracy for computing the alignment/register offset by cutting out an image region having at least one circular measuring mark from the digital overall image and determining parameters of a model of a printing point of the circular measuring mark from the digital overall image.

2. The method according to claim 1, which further comprises placing the circular measuring marks on the printing substrate so as to be completely acquired by a single camera and imaged in a single digital overall image.

3. The method according to claim 1, which further comprises using closed circular disks or open circular rings of known diameter as the circular measuring marks for each color separation.

4. The method according to claim 1, which further comprises carrying out the method by:

ascertaining an alignment offset between printing bars having printheads disposed adjacent one another in an inkjet printing press; and placing the circular measuring marks in lines horizontally or vertically on the printing substrate.

5. The method according to claim 4, which further comprises using the computer for ascertaining the alignment offset between the printing bars by:

determining deviations of the center position of the circular measuring mark from known ideal positions;

applying an outlier-robust regression method to average the deviations over the printing substrate; and using the computer to ascertain and compensate for the alignment offset by oppositely driving the printing bars.

6. The method according to claim 5, which further comprises not printing the circular measuring marks in an overlap region between two printheads.

7. The method according to claim 4, which further comprises not printing the circular measuring marks in an overlap region between two printheads.

8. The method according to claim 1, which further comprises carrying out the method for ascertaining the alignment/register offset in an offset printing press by:

integrating the circular measuring marks into existing printing control strips; and using the circular measuring marks to replace previous color measuring fields.

* * * * *